US012162721B2

(12) United States Patent
Suzuki et al.

(10) Patent No.: US 12,162,721 B2
(45) Date of Patent: Dec. 10, 2024

(54) SHEET FEEDING DEVICE AND IMAGE FORMING APPARATUS

(71) Applicant: CANON KABUSHIKI KAISHA, Tokyo (JP)

(72) Inventors: Masato Suzuki, Shizuoka (JP); Satoshi Tsuda, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 101 days.

(21) Appl. No.: 17/872,642

(22) Filed: Jul. 25, 2022

(65) Prior Publication Data

US 2023/0032618 A1 Feb. 2, 2023

(30) Foreign Application Priority Data

Jul. 27, 2021 (JP) ..... 2021-122286

(51) Int. Cl.
*B65H 3/06* (2006.01)
*B65H 9/10* (2006.01)

(52) U.S. Cl.
CPC ..... *B65H 9/101* (2013.01); *B65H 2801/06* (2013.01)

(58) Field of Classification Search
CPC ..... B65H 3/0684; B65H 3/0669; B65H 2601/324; B65H 9/101; B65H 2403/732; B65H 2403/73; B65H 2402/60
See application file for complete search history.

(56) References Cited

U.S. PATENT DOCUMENTS

2017/0029226 A1* 2/2017 Nishioka ..... B65H 3/0669
2018/0148283 A1* 5/2018 Suzuki ..... G03G 21/1647
2021/0094775 A1* 4/2021 Tsuda ..... B65H 3/0669

FOREIGN PATENT DOCUMENTS

JP 2017-121990 A 7/2017
JP 2020-066528 A 4/2020
JP 2021-054569 A 4/2021

* cited by examiner

*Primary Examiner* — Luis A Gonzalez
(74) *Attorney, Agent, or Firm* — Canon U.S.A., Inc. IP Division

(57) ABSTRACT

A sheet feeding device includes a driving transmission member, a feeding unit, and a switching member. The feeding unit is detachable from the sheet feeding device and includes a driven transmission member that receives a driving force from the driving transmission member, a feeding member, and a holding member that holds the driven transmission member and the feeding member. The switching member abuts the holding member and moves the feeding member between a second position and a first position lowered from the second position. When the driving force is transmitted to the driven transmission member, the feeding unit is positioned to the sheet feeding device by receiving a positioning force in an attachment direction of the feeding unit. When the driving force is not transmitted to the driven transmission member, the feeding unit is regulated by the switching member in movement in a direction opposite to the attachment direction.

12 Claims, 11 Drawing Sheets

SHEET FEEDING DEVICE AND IMAGE FORMING APPARATUS

BACKGROUND

Field

The present disclosure relates to a sheet feeding device including a detachable unit, and an image forming apparatus.

Description of the Related Art

An image forming apparatus, such as a copier and a printer, includes a sheet feeding device that conveys a sheet from a storage unit. The sheet feeding device includes a feeding unit that conveys a sheet stacked in the storage unit toward an image forming unit, and the feeding unit is configured as a unit detachable from the sheet feeding device.

The feeding unit includes a conveyance rotating body including a friction portion made of, for example, a rubber. When a sheet is fed, the conveyance rotating body abuts on the sheet, and rotates to feed the sheet to the image forming unit.

In a case where the rubber of the conveyance rotating body is degraded by abrasion or the like, the feeding performance may be deteriorated. Thus, the feeding unit may be periodically replaced by a user or a service engineer.

Japanese Patent Application Laid-Open No. 2017-121990 discusses a configuration for incorporating a replaceable feeding unit.

SUMMARY

The present disclosure is directed to a sheet feeding device that prevents a feeding unit detachable from the sheet feeding device from accidentally discharged from the sheet feeding device, and to an image forming apparatus.

According to an aspect of the present disclosure, a sheet feeding device includes: a driving transmission member configured to rotate around a first rotation axis, a storage unit including a stacking member and configured to store sheets stacked on the stacking member, a feeding unit configured to be detachable from the sheet feeding device and including a driven transmission member, a feeding member, and a holding member configured to hold the driven transmission member and the feeding member, wherein the driven transmission member is configured to be engageable with the driving transmission member and to receive a driving force from the driving transmission member in a state where the feeding unit is attached to the sheet feeding device, and the feeding member is configured to rotate by rotation of the driven transmission member being rotated by the received driving force and to feed the sheets stacked on the stacking member, a separation unit configured to separate the sheets fed by the feeding unit one by one, and a switching member configured to abut on the holding member and to switch a position of the feeding member by moving the feeding member between a second position and a first position lowered from the second position, wherein, in a state where the driving force is transmitted from the driving transmission member to the driven transmission member, the feeding unit is positioned to the sheet feeding device by receiving a positioning force in an attachment direction of the feeding unit, and wherein, in a state where the driving force is not transmitted from the driving transmission member to the driven transmission member, the feeding unit is regulated by the switching member in movement in a direction that is opposite to the attachment direction of the feeding unit.

Further features of the present disclosure will become apparent from the following description of exemplary embodiments with reference to the attached drawings.

DESCRIPTION OF THE EMBODIMENTS

Some exemplary embodiments of the present disclosure are described below with reference to drawings.

Figure 1:
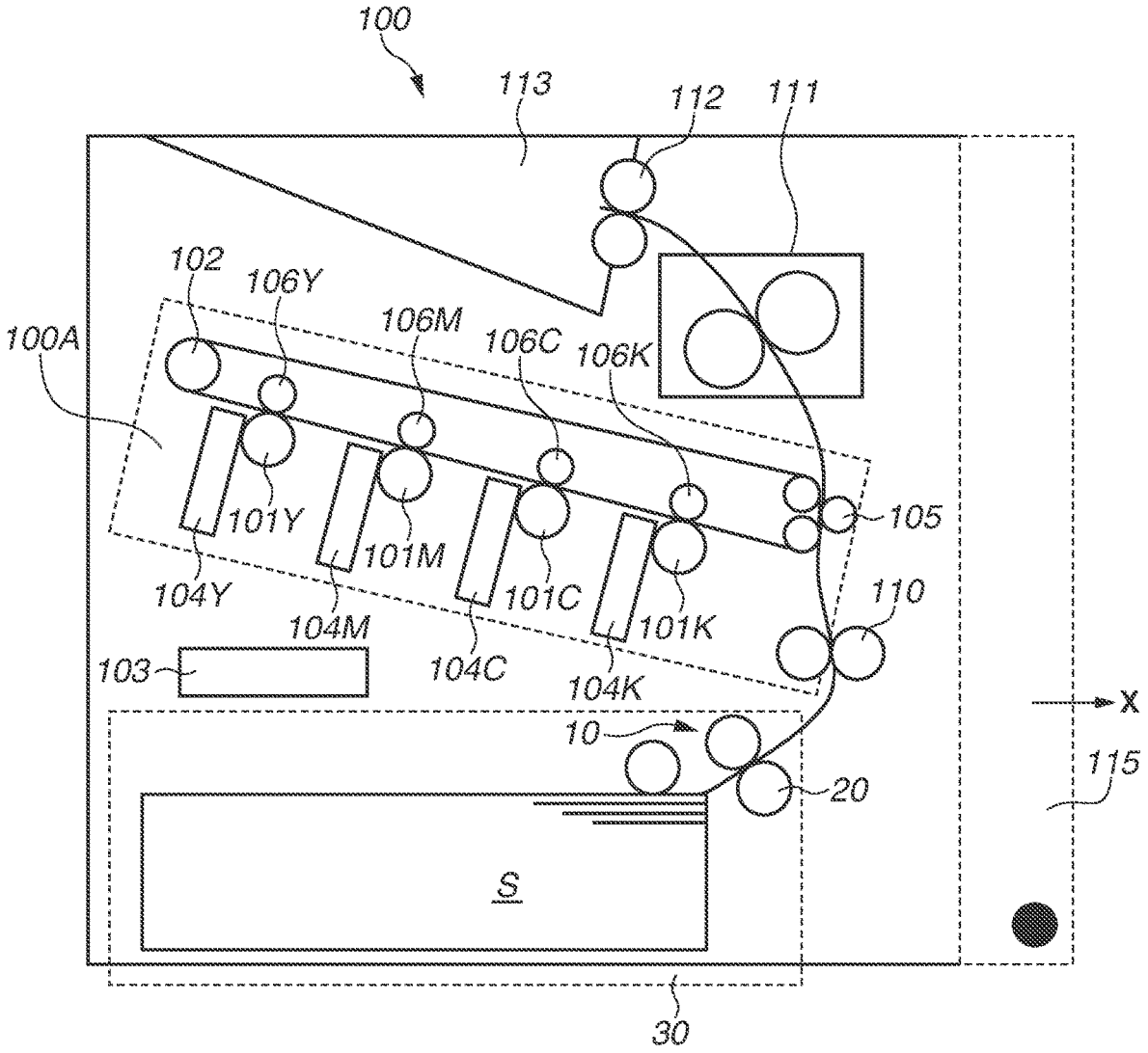
FIG. 1 is a schematic diagram illustrating a sheet feeding device and an image forming apparatus.

FIG. 1 is a schematic diagram of a sheet feeding device and an image forming apparatus according to a first exemplary embodiment. As the image forming apparatus, an electrophotographic color laser printer (hereinafter, printer 100) is described as an example with reference to the drawings. While, in the present exemplary embodiment, the printer 100 employs an electrophotographic system, the present disclosure is not limited thereto and is applicable to an inkjet system.

While, in the present exemplary embodiment, a part of the printer 100 is included in a sheet feeding device 30 for feeding a sheet, the sheet feeding device may have the other configuration. The present exemplary embodiment can be applied to, for example, a feeding deck connected as an optional device to the printer 100 as the sheet feeding device. While, a feeding unit is described as an example of a replaceable unit, the present disclosure is not limited thereto, and the configuration of the present exemplary embodiment is applicable to a unit detachably attached to the printer 100.

As illustrated in FIG. 1, the printer 100 includes an image forming unit 100A and the sheet feeding device 30. The image forming unit 100A includes four photosensitive drums 101Y, 101M, 101C, and 101K for forming toner images of four colors of yellow, magenta, cyan, and black, respectively. The image forming unit 100A further includes an endless intermediate transfer belt 102 that is in contact with the four photosensitive drums 101Y, 101M, 101C, and 101K and to which the toner images formed on the four photosensitive drums 101Y, 101M, 101C, and 101K are primarily transferred. The image forming unit 100A further includes primary transfer rollers 106Y, 106M, 106C, and 106K which press the photosensitive drums 101Y, 101M, 101C, and 101K, respectively, from an inner peripheral side of the intermediate transfer belt 102. Each of the primary transfer rollers 106Y, 106M, 106C, and 106K receives a transfer voltage from a transfer power supply (not illustrated), and generates a potential difference between a corresponding one of the photosensitive drums 101Y, 101M, 101C, and 101K and the intermediate transfer belt 102. The toner images are primarily transferred from the photosensitive drums 101Y, 101M, 101C, and 101K to the intermediate transfer belt 102 by the potential differences. The image forming unit 100A further includes a secondary transfer roller 105 for secondarily transferring the images transferred to the intermediate transfer belt 102, to a sheet S.

When image forming operation is started in the image forming unit 100A, light corresponding to an image signal is applied from a laser scanner 103 to the photosensitive drums 101Y, 101M, 101C, and 101K each charged to a predetermined potential. As a result, electrostatic latent images are formed on the photosensitive drums 101Y, 101M, 101C, and 101K.

Next, development is performed with toner housed in development cartridges 104Y, 104M, 104C, and 104K to form toner images (visible images) on the photosensitive drums 101Y, 101M, 101C, and 101K. The toner images formed on the photosensitive drums 101Y, 101M, 101C, and 101K are then primarily transferred to the intermediate transfer belt 102. The toner images on the intermediate transfer belt 102 are conveyed to a secondary transfer portion by the intermediate transfer belt 102.

In parallel with the above-described toner image forming operation, sheets S are fed one by one from the sheet feeding device 30. Each sheet S is conveyed by a registration roller 110 for skew correction, to the secondary transfer portion formed by a nip between the intermediate transfer belt 102 and the secondary transfer roller 105.

In this process, it is necessary to adjust sheet conveyance direction and position of the sheet S to the toner images formed on the intermediate transfer belt 102. Thus, timing adjustment of the sheet S is performed by controlling a conveyance speed of the registration roller 110. After the adjustment, the toner images are transferred from the intermediate transfer belt 102 to the sheet S by a secondary transfer voltage applied to the secondary transfer roller 105 at the secondary transfer portion.

The sheet S to which the toner images have been transferred is then conveyed to a fusing unit 111. The toner images are fused to the sheet S by being heated and pressurized by the fusing unit 111. After fusing, the sheet S is discharged to a discharge portion 113 on an upper side of the apparatus by a discharge roller 112.

The printer 100 includes a door 115 that is openable/closable member. When the door 115 is opened, an inside of the printer 100 is exposed. For example, when the door 115 is opened and the inside of the printer 100 is exposed, a separation unit 20 (see FIG. 2A) described below and a feeding unit 10 (see FIG. 2A) are exposed and detachable in an X direction. The separation unit 20 and the feeding unit 10 are replaceable units that are replaceable and detachable from the printer 100.

Residual toner remaining on the intermediate transfer belt 102 is removed by a cleaning unit (not illustrated), and is housed in a collected toner container (not illustrated). The collected toner container is a replaceable unit of the printer 100 and replaceable through the door 115.

Figure 2A:
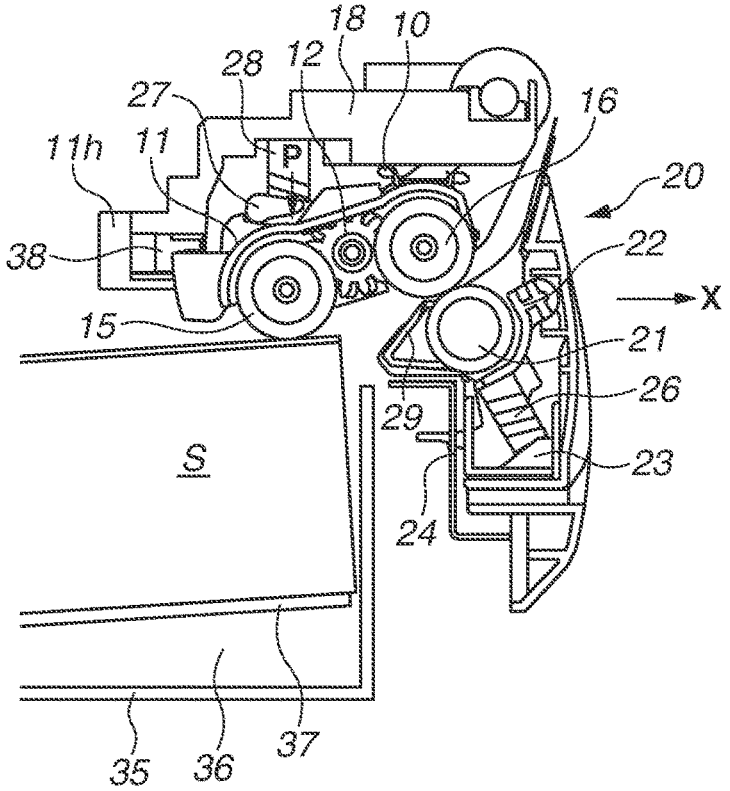
FIG. 2A is a cross-sectional view illustrating a state where a feeding unit is at an abutting position.
Figure 2B:
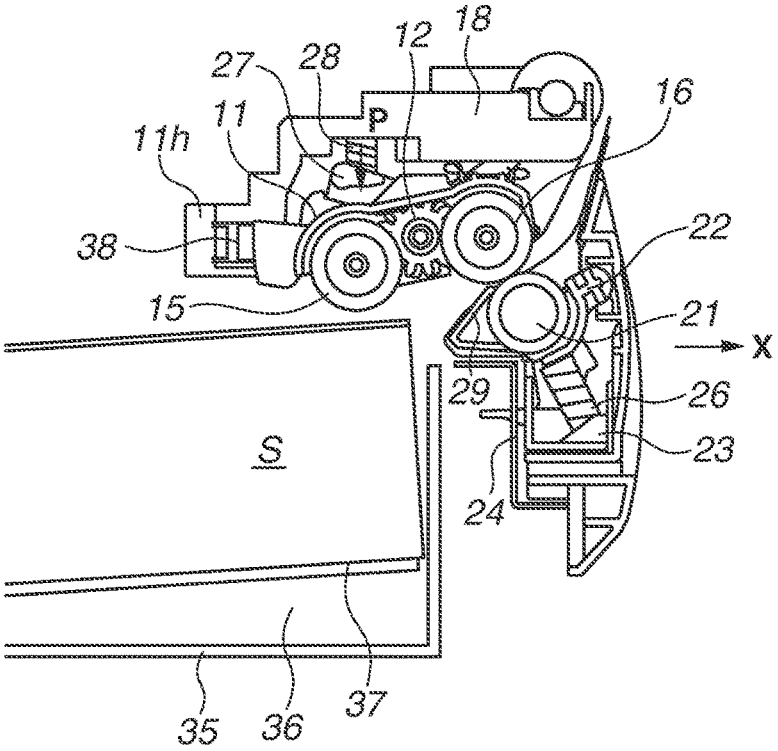
FIG. 2B is a cross-sectional view illustrating a state where the feeding unit is at a separated position.

Next, the sheet feeding device 30 according to the present exemplary embodiment is described with reference to FIG. 1, FIGS. 2A and 2B, and FIGS. 3A and 3B. FIG. 2A illustrates a state where the feeding unit 10 is at an abutting position, and FIG. 2B illustrates a state where the feeding unit 10 is at a separated position.

The sheet feeding device 30 includes the feeding unit 10, the separation unit 20, and a feeding driving unit (not illustrated). The sheet feeding device 30 further includes a storage cassette 35 that is detachable from the sheet feeding device 30 and can store a plurality of sheets S. The storage cassette 35 as a storage unit includes a cassette tray 36 as a storage portion, and a stacking plate 37 that is a stacking member on which the sheets S are stacked and serves as a lift-up unit for the sheets S. The stacking plate 37 is swingably provided in the cassette tray 36.

As described above, the feeding unit 10 is detachable from the printer 100 in the X direction in the drawings, and is replaceable. The feeding unit 10 includes a roller holder 11 serving as a first support member, a pickup roller 15 serving as a feeding member, a feed roller 16 serving as a conveyance member, and an idler gear 12. The roller holder 11 rotatably holds the pickup roller 15, the feed roller 16, and the idler gear 12.

The feeding unit 10 is movably held by a support frame 18 as a support member. In a state where the feeding unit 10 is attached to the support frame 18, the feeding unit 10 is held by the support frame 18 to be pivotable around a rotation axis (second rotation axis) 16C of the feed roller 16. Further, the feeding unit 10 is urged in a direction P by an urging spring 28 serving as a first urging member via a feeding pressure arm 27 as a pressurization member. When feeding operation described below is performed, the pickup roller 15 is brought into pressure contact with the sheet S stacked on the stacking plate 37 at a predetermined urging force. A position of the pickup roller 15 as illustrated in FIG. 2A is referred to as a first position, and a position of the feeding unit 10 in the first position is referred to as the abutting position.

The feeding unit 10 is also provided with a mechanism for separating the pickup roller 15 from the sheet S as illustrated in FIG. 2B when the feeding operation is not performed. This is to prevent attachment/detachment workability of the feeding unit 10 and operability of the storage cassette 35 from being deteriorated by frictional resistance between the sheet S and the pickup roller 15. A position of the pickup roller 15 separated from the sheet S is referred to as a second position, and a position of the feeding unit 10 in the second position is referred to as the separated position. The support frame 18 includes a photo-interrupter 38 serving as a detection unit. A height of an uppermost surface of the sheet S in the cassette tray 36 is detected by the photo-interrupter 38 and a sheet surface detection flag 11*h* provided in the feeding unit 10. As described above, the pickup roller 15 can move between the second position and the first position lowered from the second position by the feeding pressure arm 27. The pickup roller 15 and the feed roller 16 are conveyance rotating bodies to convey the sheet.

The separation unit 20 includes a separation roller 21 serving as a separation member, a separation roller holder 22 serving as a second support member, a separation base 23 serving as a base portion, a separation spring 26 serving as an urging member, and a separation cover 24 that engages with the separation base 23 and covers the built-in members. A small-sized torque limiter is incorporated inside the separation roller 21, and a brake with a predetermined torque is applied in a rotation direction. The separation unit 20 is attached to the sheet feeding device 30 (configuring part of printer 100 in the present exemplary embodiment) in such a manner that the separation roller 21 is set at a position facing the feed roller 16. The separation roller 21 is pressed against the feed roller 16 by an urging force of the separation spring 26. The separation unit 20 is also held to be detachable from the sheet feeding device 30 in the X direction. In the present exemplary embodiment, attachment/detachment of the feeding unit 10 is performed after the separation unit 20 is detached. Such a configuration enables a user to access the separation unit 20 and the feeding unit 10 from the same direction. This is excellent in workability.

Figure 3A:
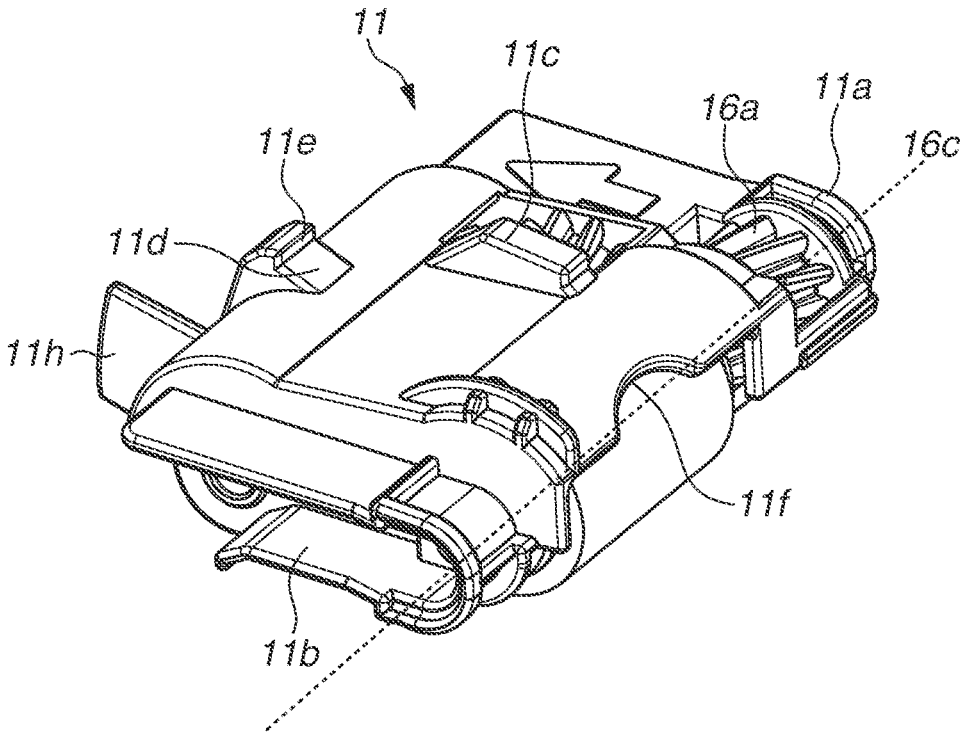
FIG. 3A is a schematic perspective view of the feeding unit as viewed from above.
Figure 3B:
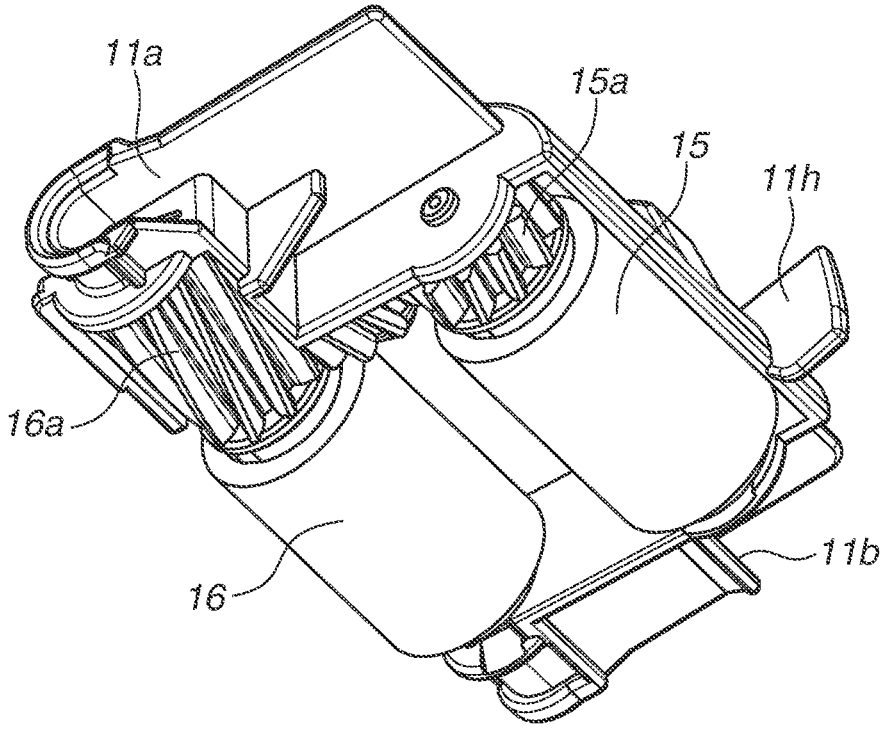
FIG. 3B is a schematic perspective view of the feeding unit as viewed from below.

In the present exemplary embodiment, to enhance replaceability of the pickup roller 15 and the feed roller 16, the pickup roller 15 and the feed roller 16 are configured as an integrated replaceable unit (feeding unit 10). The feeding unit 10 is described with reference to FIGS. 2A and 2B and FIGS. 3A and 3B. FIG. 3A is a schematic perspective view of the feeding unit 10 as viewed from above. FIG. 3B is a schematic perspective view of the feeding unit 10 as viewed from below.

As illustrated in FIGS. 3A and 3B, the pickup roller 15, the feed roller 16, the roller holder 11, and the idler gear 12 are integrated as the feeding unit 10. The pickup roller 15 and the feed roller 16 include driven gears 15*a* and 16*a* respectively, both of which are helical gears, and the driven gears 15*a* and 16*a* of the respective rollers are coupled by the idler gear 12 that is a helical gear.

Figure 4A:
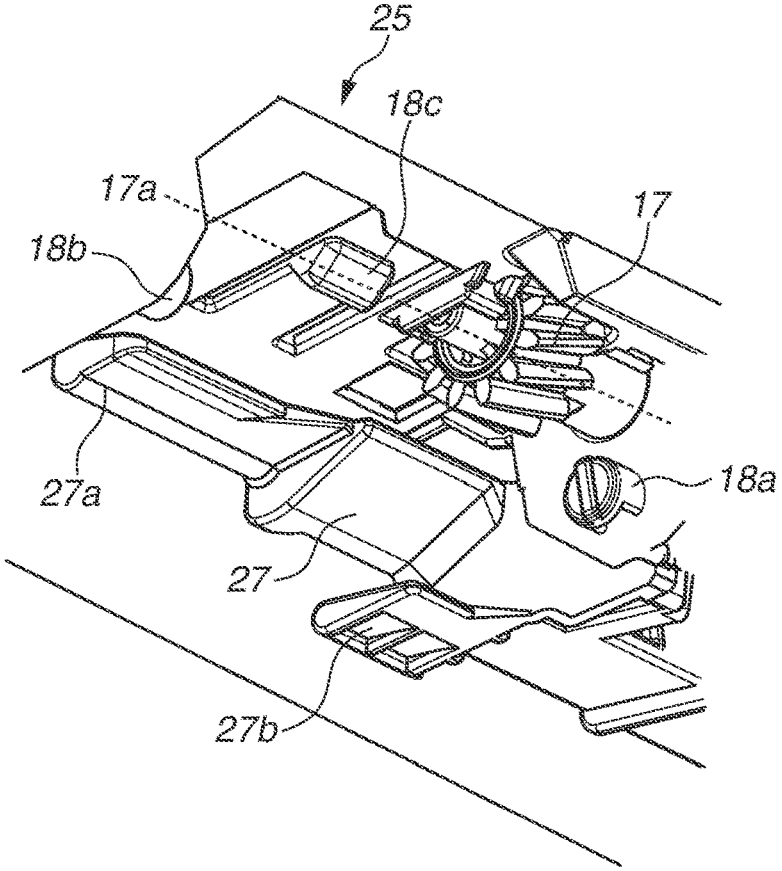
FIG. 4A is a schematic perspective view illustrating a configuration of a feeding support unit in a state where the feeding unit is detached.

In a state where the feeding unit 10 is attached to the sheet feeding device 30, the driven gear 16*a* that is a driven transmission member of the feed roller 16 can engage with an input gear 17 (FIGS. 4A and 4B) that is a driving transmission member described below and is a helical gear. The input gear 17 is the driving transmission member rotating around a first rotation axis 17*a* (FIG. 4A). The driven gear 16*a* engages with the input gear 17 at a position different from a position of the driven gear 16*a* engaging with the idler gear 12, in a longitudinal direction.

A rotation center of the input gear 17 and a rotation center of the driven gear 16*a* are arranged in a direction substantially orthogonal to an attachment/detachment direction of the feeding unit 10. The feed roller 16 and the pickup roller 15 are driven in conjunction with each other by receiving a rotational driving force from the input gear 17. A one-way clutch (not illustrated) is incorporated in each of the pickup roller 15 and the feed roller 16. In a case where the conveyance speed of the sheet S by the registration roller 110 is higher than a conveyance speed of the sheet S by the pickup roller 15 and the feed roller 16, the driving force is not transmitted, and the pickup roller 15 and the feed roller 16 run idle. This configuration can prevent, when the sheet S is conveyed at the conveyance speed of the registration roller 110, occurrence of slipping between the sheet S and the pickup roller 15 and the feed roller 16 which are rotated in a lower speed, whereby abrasion of a rubber roller can be prevented from being developed.

The roller holder 11 serving as a holding member includes slit portions 11*a* and 11*b* a protruding portion 11*c* an abutting portion 11*d* and a regulated portion 11*e*. The slit portions 11*a* and 11*b* serving as guided portions are provided as ribs protruding from the roller holder 11 toward outside, on an outside of the whole of the feed roller 16 in an axis direction of the feed roller 16. Each of the slit portions 11*a* and 11*b* extends from the feed roller 16 toward the pickup roller 15, and has a U-shape in which an end on the pickup roller 15 side is opened. The slit portions 11*a* and 11*b* have a function to guide movement of the feeding unit 10.

The protruding portion 11*c* engages with a click claw 18*c* provided on the support frame 18 (FIG. 4B) when the feeding unit 10 is attached to the sheet feeding device 30. The abutting portion 11*d* is a surface provided just above the pickup roller 15 and abuts on the feeding pressure arm 27. The regulated portion 11*e* is a surface coming into contact with the feeding pressure arm 27 when the feeding unit 10 is at the abutting position and a force causing the feeding unit 10 to be discharged in the X direction is applied. Actions of these shapes are described in detail below. The roller holder 11 includes the sheet surface detection flag 11*h* as a detected member.

Figure 4B:
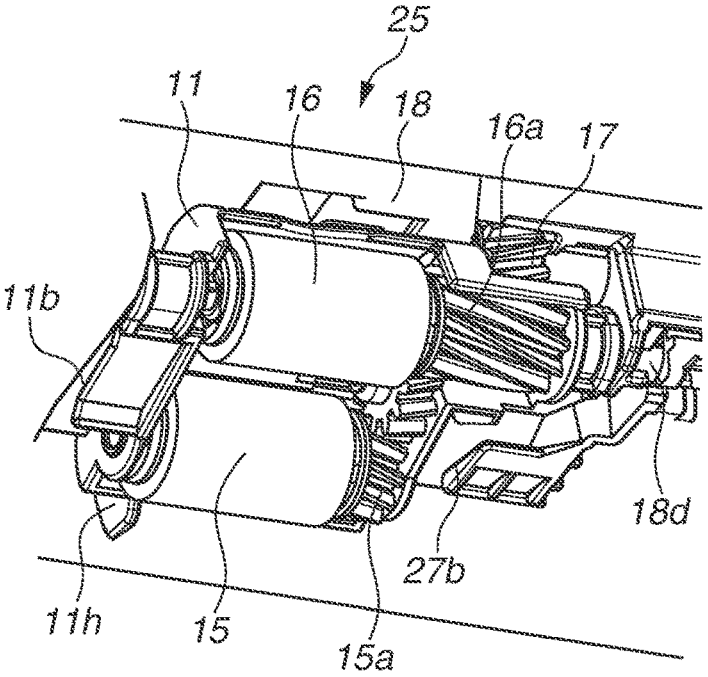
FIG. 4B is a schematic perspective view illustrating the configuration of the feeding support unit in a state where the feeding unit is attached.

Next, a feeding support unit 25 to which the feeding unit 10 is attached is described with reference to FIGS. 4A and 4B. FIGS. 4A and 4B are schematic views each illustrating a configuration of the feeding support unit 25. FIG. 4A illustrates a state where the feeding unit 10 is detached, and FIG. 4B illustrates a state where the feeding unit 10 is attached.

As illustrated in FIGS. 4A and 4B, the feeding support unit 25 includes the support frame 18 serving as the support member, the input gear 17 serving as the driving transmission member, and the feeding pressure arm 27 serving as a regulation member, and is configured to detachably support the feeding unit 10. The feeding pressure arm 27 is a switching member for switching the position of the pickup roller 15. The support frame 18 includes positioning bosses 18*a* and 18*b* (positioning portions) to regulate movement of the feeding unit 10 toward an upstream side in the conveyance direction and to position the feeding unit 10. The support frame 18 includes the click claw 18*c* and a feeding pressure arm spindle 18*d*.

The positioning bosses 18*a* and 18*b* that are protrusions protruding toward an inside of the support frame 18 are disposed on the rotation axis of the feed roller 16 in the state where the feeding unit 10 is attached. The positioning bosses 18*a* and 18*b* engage with the slit portions 11*a* and 11*b* of the roller holder 11, respectively, to position the feeding unit 10. The click claw 18*c* is deflected in a process of attaching the feeding unit 10, and engages with the protruding portion 11*c* of the roller holder 11 with a gap when attachment of the feeding unit 10 to the sheet feeding device 30 is completed. The feeding pressure arm spindle 18*d* is disposed coaxially with the positioning bosses 18*a* and 18*b*, and rotatably supports the feeding pressure arm 27.

The input gear 17 is rotatably supported by the support frame 18. In the state where the feeding unit 10 is attached to the apparatus main body (FIG. 4B), the input gear 17 engages with the driven gear 16*a* of the feed roller 16. When the sheet feeding device 30 performs the feeding operation, the input gear 17 rotates by receiving a rotational driving force via a clutch inside a feeding drive (not illustrated), and applies the rotational driving force to the driven gear 16*a* of the feed roller 16. In other words, when the clutch is not coupled, the input gear 17 can run idle.

The feeding pressure arm 27 includes a pressing portion 27*a*, a guide portion 27*b*, and a regulation portion 27*c* (FIG. 9 described below) that abuts on the regulated portion 11*e* of the roller holder 11 at the abutting position and regulates movement of the roller holder 11 toward the downstream in the conveyance direction. The pressing portion 27*a* and the regulation portion 27*c* form a continuous curved-surface shape, and are respective parts of the curved-surface shape. The downstream side in the conveyance direction is a direction opposite to the attachment direction of the feeding unit 10. The feeding pressure arm 27 is pivotably supported by the feeding pressure arm spindle 18*d* of the support frame 18.

The feeding pressure arm 27 is connected to the urging spring 28 (see FIGS. 2A and 2B) at a position (not illustrated). When the feeding unit 10 is at the abutting position, the pressing portion 27*a* abuts on the abutting portion 11*d* of the roller holder 11. In the state, the pressing portion 27*a* transmits a force of the urging spring 28 to the sheet S via the pickup roller 15. The guide portion 27*b* engages with the slit portion 11*a* of the roller holder 11, and guides the feeding unit 10 to an attachment locus. When the feeding unit 10 is at the separated position, a front end of the guide portion 27*b* supports the slit portion 11*a* of the roller holder 11 to hold the feeding unit 10 at the separated position. In other words, a backlash is provided between the feeding unit 10 and both of the pressing portion 27*a* and the guide portion 27*b* of the feeding pressure arm 27.

In a case where, at the abutting position, the stacking plate 37 serving as the lift-up unit for the sheet S is lowered and the uppermost surface of the sheet S and the pickup roller 15 do not abut on each other, the feeding unit 10 is supported by the guide portion 27*b* with its own weight. When the stacking plate 37 rises, the uppermost surface of the sheet S comes into contact with the pickup roller 15, and the pressing portion 27*a* and the abutting portion 11*d* of the roller holder 11 abut on each other, the force of the urging spring 28 is transmitted to the sheet S. Next, a detachment configuration of the separation unit 20 is described.

Figure 5A:
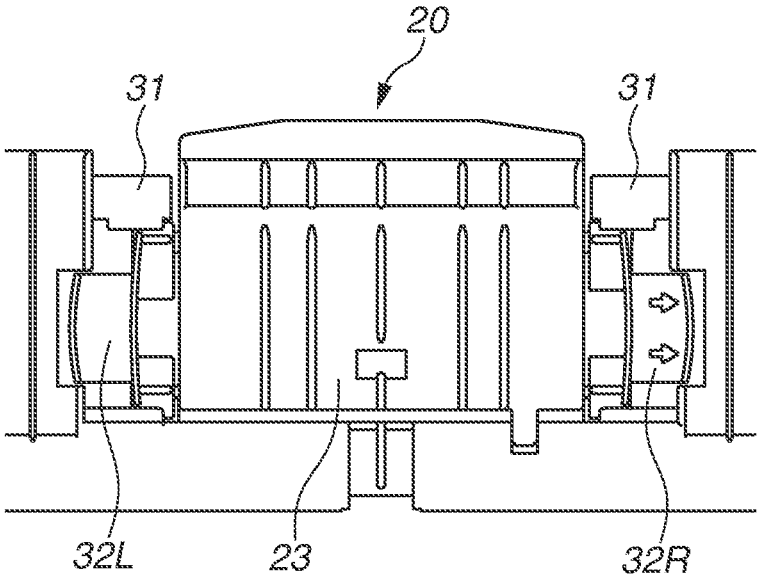
FIG. 5A is a diagram illustrating a support configuration of a separation unit when the sheet feeding device is viewed from a right side in the diagram illustrated in FIG. 1 in a state where a door is opened.
Figure 5B:
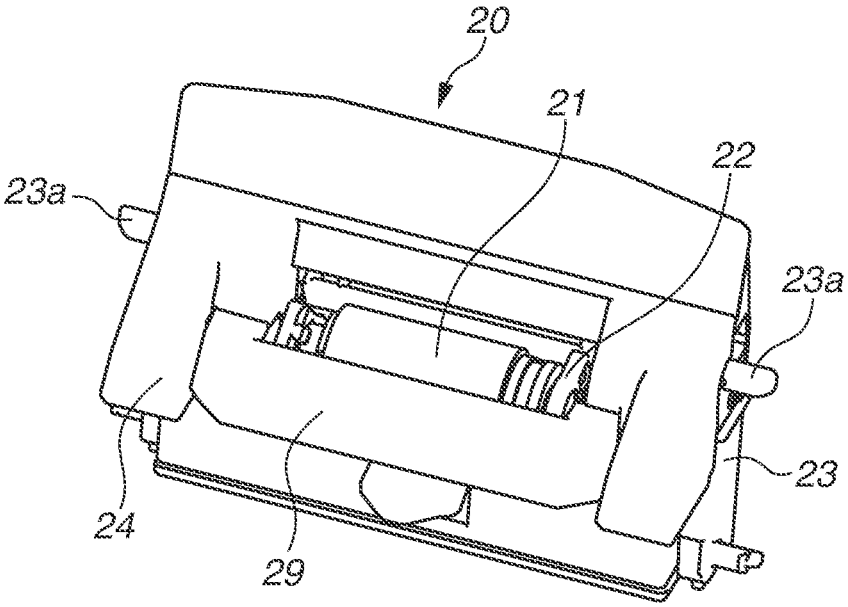
FIG. 5B is a diagram of the sheet feeding device in a state where the separation unit is detached.

FIGS. 5A and 5B are diagrams when the sheet feeding device 30 is viewed from a right side in the drawing in a state where the door 115 (FIG. 1) is opened. FIG. 5A is a diagram illustrating a support configuration of the separation unit 20, and FIG. 5B is a diagram illustrating a detached and separated state of the separation unit 20.

Figure 6A:
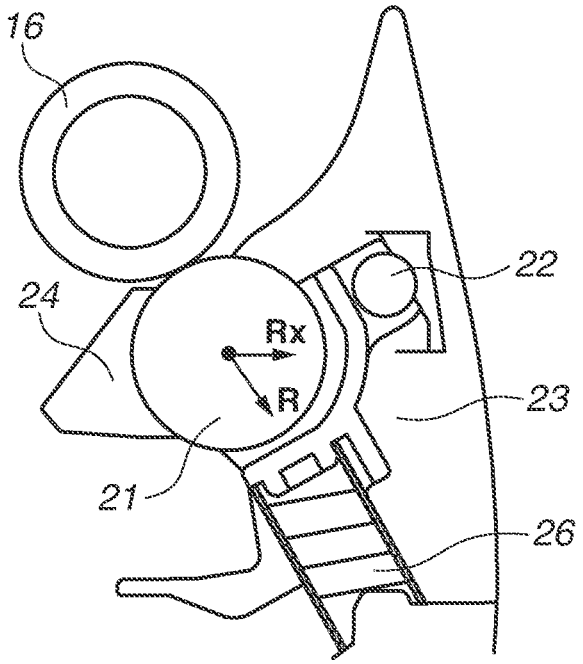
FIG. 6A is a schematic cross-sectional view of the separation unit and a separation support frame.
Figure 6B:
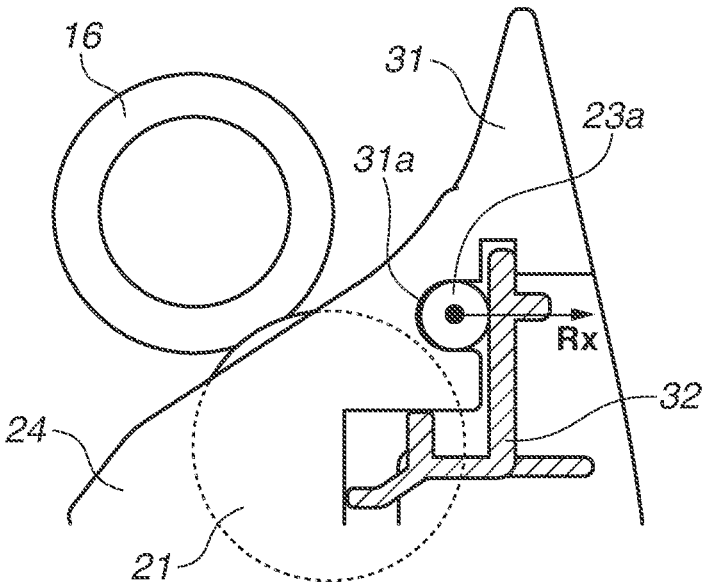
FIG. 6B is an enlarged cross-sectional view of the separation unit and the separation support frame.

FIGS. 6A and 6B each illustrate a cross-sectional configuration of the separation unit 20 and a separation support frame 31. FIG. 6A illustrates a pressurization configuration of the separation unit 20, and FIG. 6B illustrates a positioning configuration of the separation unit 20 and the separation support frame 31 in the conveyance direction and a height direction.

The separation support frame 31 in FIG. 5A supports the separation unit 20. A separation shutter 32 is disposed each on right and left sides of the separation support frame 31. The separation shutter 32 on the right side in FIG. 5A is a separation shutter 32R, and the separation shutter 32 on the left side is a separation shutter 32L. The separation shutters 32R and 32L on both sides are urged toward a center in FIG. 5A by separation shutter urging springs (not illustrated).

In FIG. 5B, the separation base 23 includes a separation base shaft 23*a* having a cylindrical shape, on each of the both sides, and the separation base shafts 23*a* performs positioning relative to the separation support frame 31. A separation positioning portion 31*a* in FIG. 6B forms a part of a shape of the separation support frame 31. The separation positioning portion 31*a* has a semi-circular shape and a long round-hole shape in the conveyance direction, and matches with the separation base shafts 23*a* in the height direction. The separation unit 20 is positioned to the separation support frame 31 in the height direction in the above-described manner.

A hatched portion in FIG. 6B indicates a shape of the separation shutter 32. To determine the position of the separation unit 20 in the conveyance direction, the separation positioning portion 31*a* and the separation shutters 32 are disposed to hold the separation base shafts 23*a*. In the conveyance direction, the separation unit 20 is pressed by a reactive force (arrow R) of a pressing force of the separation spring 26, and a force Rx is applied in the conveyance direction. The force Rx is applied to the separation base shafts 23*a* serving as the positioning portions, and the position of the separation unit 20 is determined in a state where the separation shutters 32R and 32L receive the force Rx. While FIG. 4B illustrates an enlarged upper part of the separation unit 20 relating to the positioning of the separation unit 20 in the conveyance direction, a similar positioning configuration is also provided on a lower part of the separation unit 20.

The feeding operation by the sheet feeding device 30 is described below. When the storage cassette 35 is inserted into the sheet feeding device 30, the stacking plate 37 rises, and the uppermost sheet S and the pickup roller 15 abut on each other. When the stacking plate 37 further rises and the sheet surface detection sensor (photo-interrupter) 38 detects that a sheet surface height reaches an adequate sheet surface height, using the sheet surface detection flag 11*h* of the roller holder 11, the rising of the stacking plate 37 stops.

When the printer 100 receives a print job, the pickup roller 15 abuts on the uppermost sheet S. The pickup roller 15 and the feed roller 16 both rotate in a counterclockwise direction in FIG. 2A by receiving a driving force from the feeding driving unit (not illustrated). When the pickup roller 15 starts to rotate, the sheet S starts to move in the X direction by friction between the pickup roller 15 and the sheet S. Then, the sheet S is conveyed to a separation nip portion formed by the feed roller 16 and the separation roller 21, the sheet S is separated one by one by the separation nip portion, and is conveyed to the downstream. The sheet S conveyed to the downstream is conveyed to the registration roller 110 by rotation of the pickup roller 15 and the feed roller 16. When the print job ends, the pickup roller 15 is again separated from the uppermost sheet S.

Figure 7:
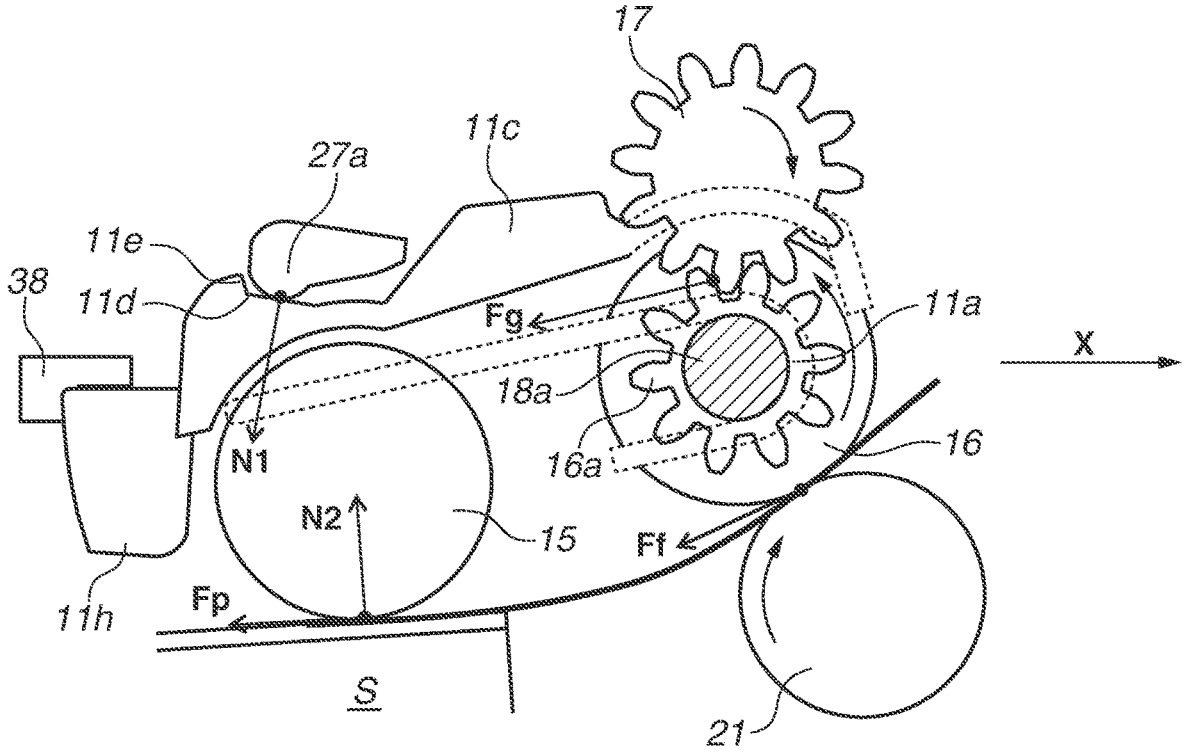
FIG. 7 is a diagram illustrating relationship of forces acting on the feeding unit during feeding operation.

FIG. 7 is a diagram illustrating relationship of forces around the feeding unit 10 during the feeding operation. During attachment operation of the feeding unit 10, the user performs an operation to push in the feeding unit 10. Since the click claw 18*c* and the feeding unit 10 are disposed with a gap, in a state where the feeding unit 10 is just pushed in, positioning of the feeding unit 10 to the support frame 18 is not completed. Position accuracy of the feed roller 16 to the sheet feeding device 30 is an important parameter influencing on feeding performance, and highly accurate positioning is required for when the sheet feeding device 30 performs the feeding operation.

When the sheet feeding device 30 performs the feeding operation, the following five forces act on the feeding unit 10. The five forces are "a force N1 applied to the roller holder 11 from the feeding pressure arm 27", "a reactive force N2 of a feeding pressure applied from the sheet S", "a frictional force Fp applied to a surface of pickup roller 15", "a frictional force Ff applied to a surface of feed roller 16", and "a driving force Fg from the input gear 17".

The force N1 from the feeding pressure arm 27 is a force acting on the abutting portion 11*d* of the roller holder 11 in a normal direction of the abutting portion 11*d*. The force N1 is a force by the urging spring 28 transmitted to the roller holder 11 via the feeding pressure arm 27, and is transmitted as the feeding pressure to the sheet S via the pickup roller 15.

The reactive force N2 of the feeding pressure applied from the sheet S is a force transmitted as the reactive force of the force N1 from the sheet S to the pickup roller 15. The frictional force Fp applied to the surface of the pickup roller 15 is a frictional force between the sheet S and the pickup roller 15, and acts on the surface of the pickup roller 15 in a direction opposite to the conveyance direction of the sheet S.

The frictional force Ff applied to the surface of the feed roller 16 is a force acting on the surface of the feed roller 16, and includes a frictional force between the sheet S and the feed roller 16, a force to rotate the separation roller 21 internally including the torque limiter, and the like. The driving force Fg from the input gear 17 is a force acting on the driven gear 16*a* of the feed roller 16 from the input gear 17, to drive the pickup roller 15 and the feed roller 16 receiving the frictional forces Fp and Ff, respectively.

As illustrated in FIG. 7, the forces N1, Fp, Ff, and Fg and resultant force of the forces N1 and N2 act in a direction opposite to the X direction. In other words, when the sheet feeding device 30 performs the feeding operation, force drawing the feeding unit 10 in the attachment direction (−X direction) to the sheet feeding device 30 acts on the feeding unit 10. As a result, the positioning bosses 18*a* and 18*b* and ends of the slit portions 11*a* and 11*b* of the roller holder 11 abut on each other, which determines the position of the feeding unit 10 in the conveyance direction.

Next, a replacement work of the feeding unit 10 is described. A worker (user) first opens the door 115 to expose the periphery of the separation unit 20 as illustrated in FIG. 5A. Next, when the worker operates the separation shutters 32 toward outside in the drawing by fingers, the separation unit 20 automatically discharged in the X direction by the force (Rx in FIG. 6A) generated by reaction of the separation spring 26. The worker grasps the discharged separation unit 20 by the fingers and detaches the separation unit 20 in the X direction. When the separation unit 20 is detached, the feeding unit 10 is exposed.

Next, the feeding unit 10 is detached from the sheet feeding device 30.

Figure 8A:
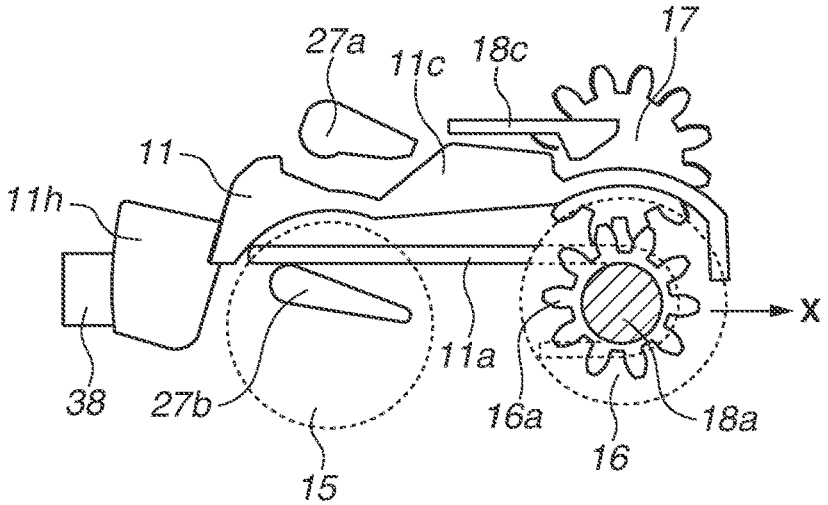
FIGS. 8A to 8C are schematic cross-sectional views each illustrating a state where the feeding unit is detached.
Figure 8B:
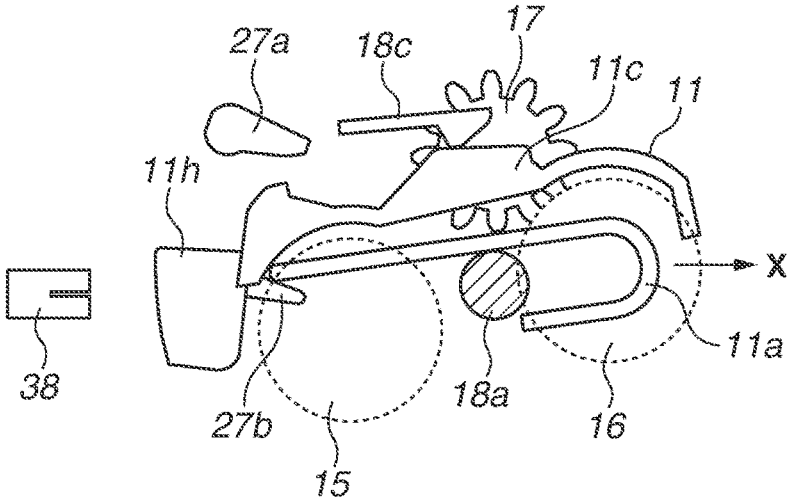
Figure 8C:
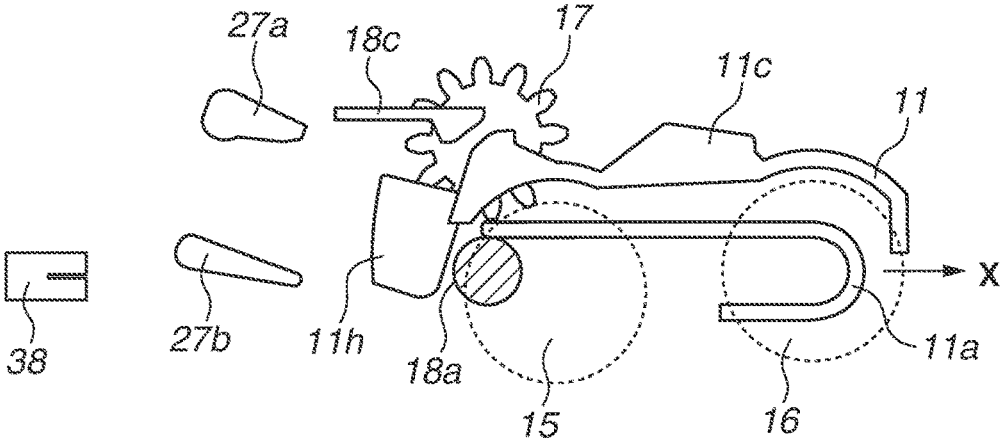

FIGS. 8A to 8C are schematic cross-sectional views each illustrating a state where the feeding unit 10 is detached. FIG. 8A illustrates a state where the feeding unit 10 is attached, and FIGS. 8B and 8C illustrate processes of detaching the feeding unit 10 from the feeding support unit 25.

The feeding unit 10 is separated from the sheet S at the time other than the feeding operation as described above. As illustrated in FIG. 8A, the feed roller 16 and the pickup roller 15 are supported in a substantially horizontal state. At the separated position, the pressing portion 27*a* of the feeding pressure arm 27 is separated from the abutting portion 11*d* of the roller holder 11, and an inner surface of the slit portion 11*a* of the roller holder 11 in the feeding unit 10 is supported by the guide portion 27*b* of the feeding pressure arm 27.

The user grasps a knob portion 11*f* of the feeding unit 10 and pulls out the feeding unit 10 in the X direction in FIG. 7. In the state where the feeding unit 10 is attached, the click claw 18*c* provided on the support frame 18 is distanced from the protruding portion 11*c* of the roller holder 11. During the operation to pull out the feeding unit 10, the user pulls out the feeding unit 10 while the protruding portion 11*c* of the feeding unit 10 deflects the click claw 18*c* upward as illustrated in FIG. 8B. Further, after the feeding unit 10 comes out of a region where the protruding portion 11*c* deflects the click claw 18*c*, resistances are all eliminated.

The movement of the feeding unit 10 in the height direction is regulated by the input gear 17, the positioning boss 18*a*, and the outer peripheral rib shape of the slit portion 11*a* as illustrated in FIG. 8C. Accordingly, the user can smoothly take out the feeding unit 10 from the sheet feeding device 30.

In the attached state, the input gear 17 provided on the support frame 18 engages with the driven gear 16*a* of the feed roller 16 as illustrated in FIG. 8A. The input gear 17 is disposed just above the feed roller 16, and is provided at a position not overlapping with the detachment direction of the feeding unit 10. The input gear 17 is disposed at such a position, which enables the user to linearly pull out the feeding unit 10 in the X direction. Further, the input gear 17 is connected to the clutch as described above, and runs idle at the time other than the driving. Accordingly, when the feeding unit 10 is detached, the input gear 17 can run idle in the counterclockwise direction in FIG. 7, and does not become an obstacle to detachment of the feeding unit 10.

Detachment of the separation unit 20 and the feeding unit 10 is completed by the above-described work. Next, a procedure of attaching a new feeding unit and a new separation unit is described.

The user grasps any part of the feeding unit 10, and pushes in the feeding unit 10 toward the left side in the drawing illustrated in FIG. 8C while aligning the slit portions 11*a* and 11*b* on both ends of the roller holder 11 to upper parts of the positioning bosses 18*a* and 18*b* of the support frame 18. In the pushing process, the feeding unit 10 is guided by the positioning bosses 18*a* and 18*b* and the guide portion 27*b* of the feeding pressure arm 27 to an attachment completion position.

Then, the user pushes in the feeding unit 10 while deflecting the click claw 18*c* of the support frame 18 upward (FIG. 8B). When the user pushes in the feeding unit 10 up to a position where the deflection of the click claw 18*c* is released, attachment of the feeding unit 10 is completed (FIG. 8A). The user can intuitively recognize completion of the attachment by virtue of the click claw 18*c*.

Although the input gear 17 engages with the driven gear 16*a* of the feed roller 16 in the attachment locus of the feeding unit 10, the input gear 17 does not become an obstacle to the user's attachment operation of the feeding unit 10 since the input gear 17 runs idle in a manner similar to the detachment operation.

After the above-described operation, the user grasps any part of the separation unit 20, and pushes the separation unit 20 to lead the separation base shafts 23*a* at both ends of the separation unit 20 straight to the separation shutters 32R and 32L on the both sides. As a result, the separation unit 20 opens the separation shutters 32R and 32R toward the outside in the drawing illustrated in FIG. 5A against the forces of the separation shutter urging springs (not illustrated). When the user further pushes in the separation unit 20, the separation unit 20 is guided to the separation positioning portion 31*a* of the separation support frame 31, and the positioning is completed. At the same time when the positioning is completed, the separation shutters 32R and 32L are closed by the forces of the separation shutter urging springs (not illustrated). This configuration enables the user to recognize completion of the attachment.

As described above, in the present exemplary embodiment, the user can complete attachment/detachment of the feeding unit 10 by simply performing the linear operation at the time of attachment and detachment of the feeding unit 10 and the separation unit 20. In other words, when detaching the feeding unit 10, the user can detach the feeding unit 10 by simply grasping and pulling out the feeding unit 10, and when attaching the feeding unit 10, the user can attach the feeding unit 10 by simply grasping and pushing in the feeding unit 10 in one direction. Likewise, when detaching the separation unit 20, the user can detach the separation unit 20 by simply releasing the separation shutters 32 to cause the separation unit 20 to be discharged and pulling out the discharged separation unit 20. When attaching the separation unit 20, the user can attach the separation unit 20 by simply pushing in the separation unit 20 in one direction to open the separation shutters 32, and the separation unit 20 is guided to the attachment position by user's further pushing.

Figure 9:
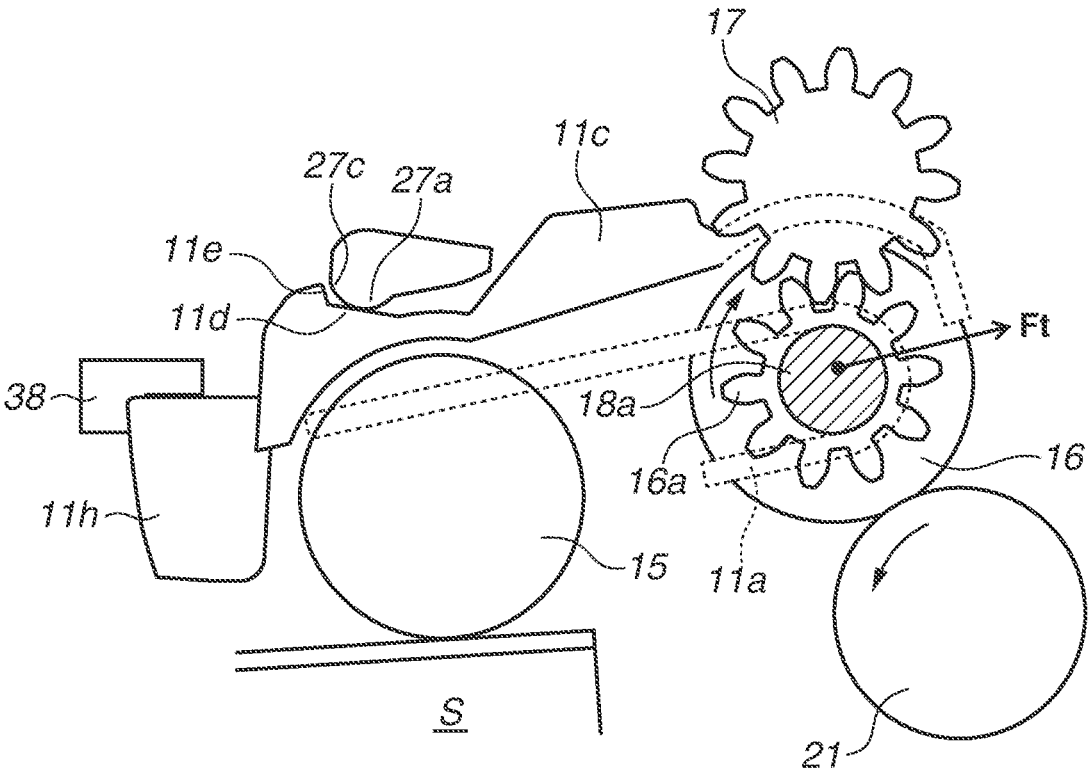
FIG. 9 is a diagram illustrating a state where a feeding member is at a first position, and driving force is not transmitted from a driving transmission member to a driven transmission member.

Next, a configuration of the regulation portion 27*c* of the feeding pressure arm 27 serving as the switching member is described. FIG. 9 is a diagram illustrating a state where the pickup roller 15 is at the abutting position and the driving force is not transmitted from the input gear 17 to the driven gear 16*a*. Behavior of the feeding unit 10 when the force causing the feeding unit 10 to be discharged is generated is described with reference to FIG. 9. A force Ft is a force applied to the feeding unit 10 in the conveyance direction, namely, a discharging force. In a case where the feeding operation is normally performed, the force drawing the feeding unit 10 in the attachment direction (−X direction) acts on the feeding unit 10. However, there can be a case where the sheet S and the pickup roller 15 may slip on each other (i.e., no pick) and the sheet S may not be conveyed. In this case, when a control unit (not illustrated) determines that a sheet is not moved for a predetermined time, the control unit turns off the clutch (not illustrated), and disconnects driving connection. When the driving connection is established, the feed roller 16 rotates the separation roller 21 in the clockwise direction by torque greater than torque of the torque limiter incorporated in the separation roller 21. Then, when the driving connection is disconnected, rotation of the feed roller 16 is stopped.

Consequently, the separation roller 21 stops rotation, and then rotates in the counterclockwise direction by returning force of the spring of the incorporated torque limiter. As a result, the feed roller 16 in contact with the separation roller 21 rotates in the clockwise direction. At this time, the discharging force Ft is generated in the feeding unit 10, and the feeding unit 10 is caused to be discharged from the sheet feeding device 30 (state in FIG. 9).

When the discharging force Ft is generated, the regulated portion 11*e* of the roller holder 11 comes into contact with the regulation portion 27*c* of the feeding pressure arm 27, and the regulation portion 27*c* can prevent the feeding unit 10 from moving in the discharging direction.

If feeding unit 10 is discharged by a predetermined amount or more, there arises a case where the pickup roller 15 cannot feed the sheet S. If the feeding unit 10 is discharged to a position where the input gear 17 and the driven gear 16*a* of the feed roller 16 do not engage with each other, the driving force is not transmitted to the driven gear 16*a* of the feed roller 16 during the feeding operation, and the sheet S cannot be conveyed. In a case where the sheet surface detection sensor 38 also serves as a detection sensor of presence/absence of the feeding unit 10, the sheet surface detection sensor 38 may not detect the feeding unit 10 because the sheet surface detection flag 11*h* moves due to the discharging of the feeding unit 10 (state in FIG. 8B). In this case, the control unit (not illustrated) determines that the feeding unit 10 is absent, and stops the feeding operation.

However, since the regulation portion 27*c* regulates discharging of the feeding unit 10 as in the present exemplary embodiment, engagement between the input gear 17 and the driven gear 16*a* can be maintained. The sheet surface detection flag 11*h* can maintain a state detectable by the sheet surface detection sensor 38.

Figure 10:
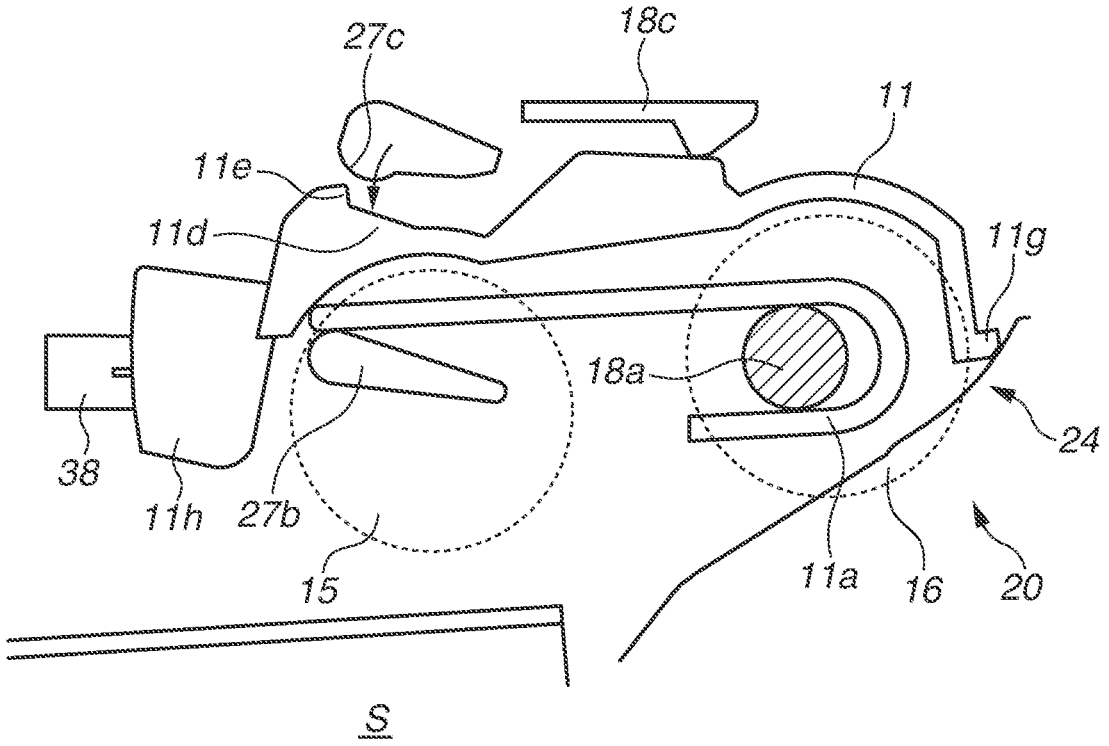
FIG. 10 is a cross-sectional view in a case where the feeding unit is not pushed into a predetermined position.

The feeding unit 10 can be drawn to a predetermined position by the protruding portion 11*c*. FIG. 10 illustrates a case where the feeding unit 10 is not pushed into the predetermined position, namely, an incomplete attachment state. FIG. 10 is a diagram illustrating the position of the feeding unit 10 when attachment of the separation unit 20 to the separation support frame 31 is completed after the feeding unit 10 is put into the incomplete attachment state.

An abutting rib 11*g* is provided on the roller holder 11 at a position where the abutting rib 11*g* comes into contact with the separation cover 24 of the separation unit 20 when the feeding unit 10 is in the incomplete attachment state. As described above, at the time other than the feeding operation, the feeding pressure arm 27 is at the separated position, and the regulation portion 27*c* of the feeding pressure arm 27 and the regulated portion 11*e* of the roller holder 11 do not contact with each other.

When the user ends the attachment operation with the feeding unit 10 in the incomplete attachment state, and then starts attachment of the separation unit 20 to the separation support frame 31, the separation unit 20 and the abutting rib 11*g* come into contact with each other. Consequently, the feeding unit 10 is pushed in by the separation unit 20. Then, when the separation unit 20 is attached to the separation support frame 31, the feeding unit 10 is regulated within a so-called first attachment position range illustrated in FIG. 10. The first attachment position range is a range where a curved-surface of the regulation portion 27*c* of the feeding pressure arm 27 can abut on the regulated portion 11*e* of the roller holder 11. In a state where the feeding unit 10 is regulated within the first attachment position range, the curved-surface of the regulation portion 27*c* of the feeding pressure arm 27 abuts on the regulated portion 11*e* of the roller holder 11 when the feeding pressure arm 27 moves. The feeding unit 10 is caught into a second attachment position range where the input gear 17 can appropriately transmit the driving force to the driven gear 16*a* of the feed roller 16, and the movement of the feeding unit 10 is regulated by the regulation portion 27*c*.

In the incomplete attachment state, the feeding unit 10 may be attached to the support frame 18 while being inclined. If the sheet S is fed in a state where the feeding unit 10 is inclined, the sheet S is skewed. Thus, after the feeding unit 10 is attached to a position within the first attachment position range, the regulation portion 27*c* of the feeding pressure arm 27 abuts on the regulated portion 11*e* of the roller holder 11 to catch the feeding unit 10, which makes it possible to eliminate inclination of the feeding unit 10.

Figure 11A:
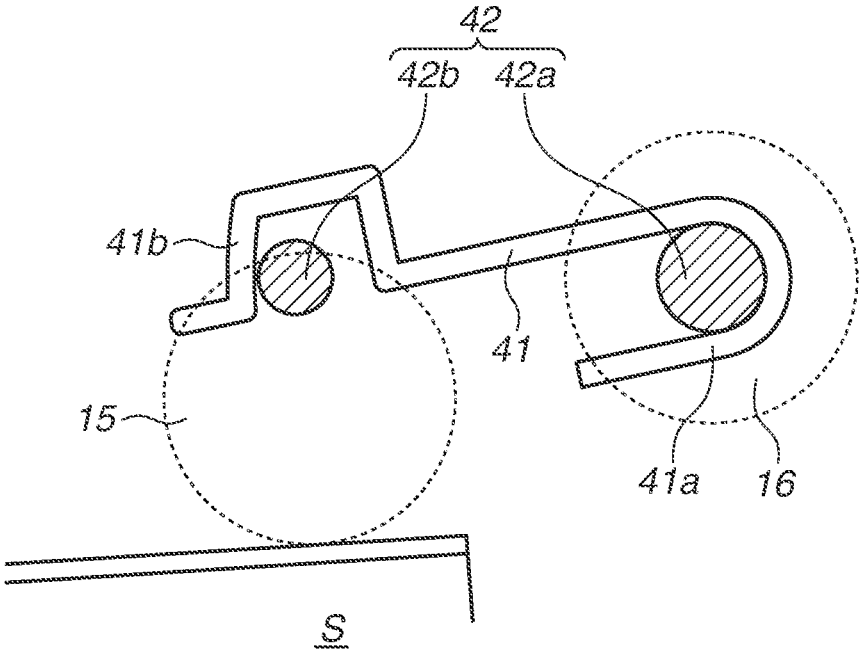
FIGS. 11A and 11B are diagrams each illustrating relationship between a feeding unit and a support unit according to a second exemplary embodiment.
Figure 11B:
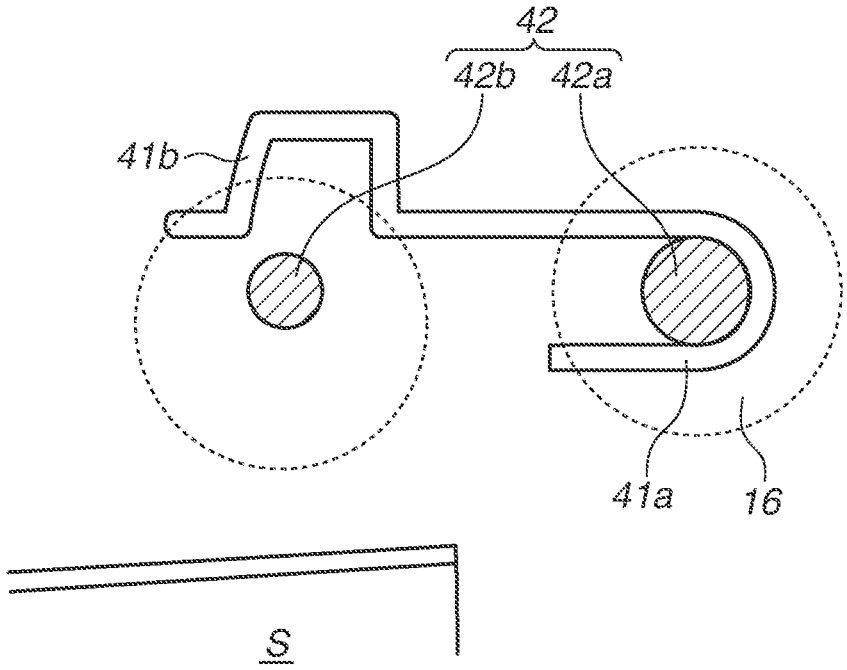

Next, a second exemplary embodiment to which the present disclosure is applied is described with reference to FIGS. 11A and 11B. A configuration of a sheet feeding device according to the present exemplary embodiment is similar to the configuration of the sheet feeding device according to the first exemplary embodiment, and FIGS. 11A and 11B illustrate the same or equivalent portions with the same reference numerals. In the first exemplary embodiment, descriptions has been given of the configuration in which the feeding pressure arm 27 for switching the position of the pickup roller 15 includes the regulation portion 27*c*. In the present exemplary embodiment, a support unit includes a regulation portion.

FIGS. 11A and 11B are diagrams illustrating relationship between the feeding unit 10 and a feeding support frame 42 according to the present exemplary embodiment. FIG. 11A illustrates a case where the feeding unit 10 is at the abutting position, and FIG. 11B illustrates a case where the feeding unit 10 is at the separated position.

The feeding unit 10 includes the pickup roller 15 and the feed roller 16, and includes the driven gears 15*a* and 16*a* and the idler gear 12 as the driving portions. The above-described parts are all pivotably supported by a roller holder 41. The roller holder 41 includes a slit portion 41*a* serving as a guide portion for attachment/detachment of the feeding unit 10 and as a positioning portion for attachment of the feeding unit 10, and a regulated portion 41*b* for regulating the movement of the feeding unit 10 of when the discharging force is applied to the feeding unit 10. The feeding unit 10 can be switched between the abutting position and the separated position by the feeding pressure arm 27.

The feeding support frame 42 is a support unit and supports the feeding unit 10 at a predetermined position. A positioning boss 42*a* and a regulation portion 42*b* are provided, and the regulation portion 42*b* abuts on the regulated portion 41*b* of the roller holder 41 when the feeding unit 10 is at the abutting position. The feeding support frame 42 includes the input gear 17. The input gear 17 engages with the driven gear 16*a* of the feed roller 16, transmits a driving force to convey the sheet S, and generates an acting force to position the feeding unit 10. The feeding support frame 42 includes the sheet surface detection sensor 38 as illustrated in FIG. 7. The sheet surface detection sensor 38 manages the sheet surface height of the sheet S and detects presence/absence of the feeding unit 10 by using a flag provided on the roller holder 41 similar to the sheet surface detection flag 11*h*.

In the state where the sheet feeding device 30 performs the feeding operation, the feeding unit 10 is at the abutting position as illustrated in FIG. 11A. When the driving force to feed the sheet S is applied in this state but slip occurs between the pickup roller 15 and the sheet S, a force toward the downstream side in the conveyance direction is applied to the feeding unit 10, and consequently the feeding unit 10 is caused to be discharged in a direction of the force. During the feeding operation, the regulated portion 41*b* of the roller holder 41 and the regulation portion 42*b* of the feeding support frame 42 have a prescribed clearance therebetween, but are close to each other. Accordingly, when the discharging force is generated, the regulated portion 41*b* of the roller holder 41 and the regulation portion 42*b* of the feeding support frame 42 abut on each other, which makes it possible to regulate further discharging of the feeding unit 10 in the discharging direction. By regulating discharging of the feeding unit 10 in the above-described manner, engagement of the input gear 17 and the feed roller 16 is secured, and the sheet-surface detection flag maintains a state detectable by the sheet surface detection sensor 38.

After the feeding operation is completed, the feeding unit 10 moves to the separated position illustrated in FIG. 11B by the feeding pressure arm 27. After the feeding unit 10 moves to the separated position, the regulated portion 41*b* of the roller holder 41 moves to a position separated from the regulation portion 42*b* of the feeding support frame 42. When the user replaces the feeding unit 10, the feeding unit 10 is at the separated position. Therefore, the feeding unit 10 can be smoothly replaced without colliding with the both regulation portions.

Providing the regulation portion 42*b* on a member fixed to the sheet feeding device 30, like the feeding support frame 42 as described above, is a simple configuration but can prevent discharging of the feeding unit 10.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2021-122286, filed Jul. 27, 2021, which is hereby incorporated by reference herein in its entirety.

What is claimed is:

1. A sheet feeding device comprising:

a driving transmission member configured to rotate around a first rotation axis;

a storage unit including a stacking member and configured to store sheets stacked on the stacking member;

a feeding unit configured to be detachable from the sheet feeding device and including a driven transmission member, a feeding member, and a holding member configured to hold the driven transmission member and the feeding member, wherein the driven transmission member is configured to be engageable with the driving transmission member and to receive a driving force from the driving transmission member in a state where the feeding unit is attached to the sheet feeding device, and the feeding member is configured to rotate by rotation of the driven transmission member being rotated by the received driving force and to feed the sheets stacked on the stacking member;

a separation unit configured to separate the sheets fed by the feeding unit one by one; and a switching member configured to abut on the holding member and to switch a position of the feeding member by moving the feeding member between a second position and a first position lowered from the second position, wherein, in a state where the driving force is transmitted from the driving transmission member to the driven transmission member, the feeding unit is positioned to the sheet feeding device by receiving a positioning force in an attachment direction of the feeding unit, and wherein, in a state where the driving force is not transmitted from the driving transmission member to the driven transmission member, the feeding unit is regulated by the switching member in movement in a direction that is opposite to the attachment direction of the feeding unit, and wherein the switching member includes a pressing portion configured to press the holding member to move the feeding member from the second position to the first position, and includes a regulation portion configured to regulate movement of the feeding unit in the opposite direction.

2. The sheet feeding device according to claim 1, wherein the pressing portion presses the holding member in a state where the feeding member is at the first position, and is separated from the holding member in a state where the feeding member is at the second position.

3. The sheet feeding device according to claim 2, wherein, in a state where the pressing portion is at a position separated from the holding member and the driving force from the driving transmission member is not transmitted from the driving transmission member to the driven transmission member, the regulation portion regulates movement of the feeding unit in the opposite direction to the attachment direction of the feeding unit by abutting on a regulated portion provided on the holding member.

4. The sheet feeding device according to claim 3, wherein each of the pressing portion and the regulation portion is a part of a continuous curved-surface shape.

5. The sheet feeding device according to claim 4, wherein, in the state where the feeding member is at the first position, the regulation portion is separated from the regulated portion.

6. The sheet feeding device according to claim 1, wherein the feeding unit is configured to be attached to and detached from a support unit provided on the sheet feeding device, and wherein the feeding unit includes a guided portion configured to guide movement of the feeding unit relative to a guide portion provided on the support unit.

7. The sheet feeding device according to claim 6, wherein the driving transmission member is an input gear provided on the support unit.

8. The sheet feeding device according to claim 7, wherein the driven transmission member is a driven gear engageable with the input gear, and wherein the input gear is able to run idle in a state where the input gear does not transmit the driving force from the driving transmission member to the driven gear.

9. The sheet feeding device according to claim 8, wherein the support unit is configured to pivotably support the switching member.

10. The sheet feeding device according to claim 9, wherein, in the state where the driving force is transmitted from the driving transmission member to the driven transmission member, the feeding unit is positioned to the sheet feeding device by the guided portion of the feeding unit receiving the positioning force in the attachment direction of the feeding unit and abutting on a positioning portion.

11. The sheet feeding device according to claim 10, wherein the feeding unit includes a conveyance member configured to convey, to a downstream side, the sheets fed by the feeding unit, and wherein the holding member is further configured to hold the conveyance member and the feeding member.

12. An image forming apparatus comprising:

the sheet feeding device according to claim 11 and configured to feed a sheet; and an image forming unit configured to form an image on the sheet fed from the sheet feeding device.

* * * * *